US006611089B2

(12) United States Patent
Kim et al.

(10) Patent No.: US 6,611,089 B2
(45) Date of Patent: Aug. 26, 2003

(54) TENSION MASK ASSEMBLY FOR COLOR CRT HAVING AT LEAST TWO DIVIDED PORTIONS

(75) Inventors: Wan Kim, Yongin (KR); Joon-Suk Park, Gunpo (KR)

(73) Assignee: Samsung SDI Co. Ltd., Kyungki-do (KR)

( * ) Notice: Subject to any disclaimer, the term of this patent is extended or adjusted under 35 U.S.C. 154(b) by 122 days.

(21) Appl. No.: 09/961,168

(22) Filed: Sep. 24, 2001

(65) Prior Publication Data

US 2002/0043920 A1 Apr. 18, 2002

(30) Foreign Application Priority Data

Oct. 13, 2000 (KR) ..... 2000-60261

(51) Int. Cl.[7] ..... H01J 29/07

(52) U.S. Cl. ..... 313/407; 313/402; 313/403; 445/47

(58) Field of Search ..... 313/402, 403, 313/404, 405, 407, 408; 445/47

(56) References Cited

U.S. PATENT DOCUMENTS 4,942,333 A * 7/1990 Knox ..... 313/402
6,097,142 A * 8/2000 Ko ..... 313/402
6,437,495 B1 * 8/2002 Akoh et al. ..... 313/402
6,437,496 B1 * 8/2002 Kim et al. ..... 313/402

* cited by examiner

*Primary Examiner*—Ashok Patel
*Assistant Examiner*—Karabi Guharay
(74) *Attorney, Agent, or Firm*—Robert E. Bushnell, Esq.

(57) ABSTRACT

A tension mask assembly for a color cathode ray tube includes a tension mask including at least two divided portions, each having a plurality of strips separated a predetermined distance from each other for forming slots, and each having a plurality of bridges for connecting the strips and defining slots, and a frame including first and second support members for supporting both end portions of the divided portions so that tension is applied to the strips of the divided portions and at least one pair of elastic members for supporting the first and second support members.

27 Claims, 7 Drawing Sheets

TENSION MASK ASSEMBLY FOR COLOR CRT HAVING AT LEAST TWO DIVIDED PORTIONS

CLAIM OF PRIORITY

This application makes reference to, incorporates the same herein, and claims all benefits accruing under 35 U.S.C. §119 from my application TENSION MASK ASSEMBLY FOR COLOR CATHODE RAY TUBE filed with the Korean Industrial Property Office on Oct. 13, 2000 and there duly assigned Ser. No. 60261/2000.

BACKGROUND OF THE INVENTION

1. Technical Field

The present invention relates to a tension mask assembly for a color cathode ray tube (CRT), and more particularly, to a tension mask assembly for a color cathode ray tube having an improved structure which can reduce vibrations generated by an external impact to the tension mask supported by a frame.

2. Related Art

In a typical color cathode ray tube (CRT), three electron beams (red, green and blue) are emitted from an electron gun installed in a neck portion of a funnel and pass through numerous electron beam passing holes formed in a shadow mask having a color selection function. Then, the electron beams land on red, green and blue fluorescent substances of a fluorescent film formed on an inner surface of a panel coupled to the funnel forming a seal. As the fluorescent substances are excited, a predetermined image is formed.

For the above color cathode ray tube, a screen surface needs to be made flat to increase a viewing angle and to prevent distortion of an image, and also a panel needs to be made flat. Accordingly, a shadow mask installed inside the color cathode ray tube and having a color selection function needs to be made flat.

The tension mask easily vibrates by a small impact applied from the outside. Thus, the electron beam emitted from the electron gun does not pass through the slots (electron beam passing holes) with a sufficient accuracy and does not land on a predetermined position on a fluorescent substance. As a result, a howling phenomenon, that is, a screen trembling, is generated and the resolution of the screen is lowered.

SUMMARY OF THE INVENTION

To solve the above problems and others, it is an object of the present invention to provide a tension mask assembly for a color cathode ray tube having an improved structure which can reduce vibrations generated by an external impact to the tension mask supported by a frame.

Accordingly, to achieve the above object and others, there is provided a tension mask assembly for a color cathode ray tube comprising a tension mask including at least two divided portions, each having a plurality of strips separated from a predetermined distance from each other for forming slots and a plurality of bridges for connecting the strips and defining slots; and a frame including first and second support members for supporting both end portions of the divided portions so that tension is applied to the strips of the divided portions and at least one pair of elastic members for supporting the first and second support members.

It is preferred in the present invention that the two adjacent divided portions are continuously connected such that separation portions of the two adjacent divided portions are overlapped each other to form slots and strips having the same shapes as those of slots and strips of the divided portions.

Also, it is preferred in the present invention that the separation portion of at least one divided portion of the two divided portions has an extended portion extending from a position where the bridges of the divided portion are identically repeated.

Also, it is preferred in the present invention that the separation portion of at least one divided portion of the two divided portions has a shape of the strip of the divided portion which is separated in a lengthwise direction.

Also, it is preferred in the present invention that an overlapped portion of the two continuously contacting divided portions has the same width as that of at least one strip.

Also, it is preferred in the present invention that the strips located at the overlapped portion of one of the two continuously contacting divided portions independently form a single slot.

Also, it is preferred in the present invention that the strips located at the overlapped portion of one of the two continuously contacting divided portions are connected by at least one bridge to form slots.

To achieve these and other objects in accordance with the principles of the present invention, as embodied and broadly described, the present invention provides a tension mask assembly for a color cathode ray tube, comprising: a tension mask including at least two divided portions, each of said portions having a plurality of first strips separated a predetermined distance from each other by first slots, and each of said portions having a plurality of first bridges for connecting said first strips to each other and for defining said first slots; and a frame including first and second support members supporting end regions of said portions, and including at least one pair of elastic members to support said first and second support members and to apply tension to said first strips of said portions.

To achieve these and other objects in accordance with the principles of the present invention, as embodied and broadly described, the present invention provides an apparatus, comprising: a tension mask including at least two divided portions, each one of said portions having a plurality of first strips separated a predetermined distance from each other by first slots, and each of said portions having a plurality of first bridges for connecting said first strips to each other and for defining said first slots; and a frame including first and second support members supporting end regions of said divided portions, and including at least one pair of elastic members to support said first and second support members and to apply tension to said first strips of said portions; adjacent divided portions selected from among said at least two divided portions partly overlapping each other at an overlapping portion, with a frictional force being formed at said overlapping portion.

To achieve these and other objects in accordance with the principles of the present invention, as embodied and broadly described, the present invention provides a method, comprising: emitting electron beams from an electron gun toward a tension mask assembly; passing said electron beams through said tension mask assembly at locations corresponding to first and second slots formed by said tension mask assembly; blocking said electron beams from passing through said tension mask assembly at locations corresponding to first and second strips formed by said tension mask assembly; blocking said electron beams from passing through said tension mask assembly at locations corresponding to first and second bridges formed by said tension mask assembly, said tension mask assembly having at least two divided portions, each one of said at least two divided portions having a plurality of said first strips separated a predetermined distance from each other by said first slots, and each of said divided portions having a plurality of said first bridges for connecting said first strips to each other and for defining said first slots, said tension mask assembly having a frame including first and second support members supporting end regions of said divided portions, and including at least one pair of elastic members to support said first and second support members and to apply tension at least to said first strips of said divided portions, each of said divided portions having at least one edge region, said edge regions of adjacent ones of said divided portions overlapping each other and being connected with each other at an overlapping portion, said overlapping edge regions forming said second slots and said second strips at said overlapping portion, said first strips having same shape as said second strips, said first slots having same shape as said second slots; and forming a frictional force between said adjacent ones of said divided portions, at said overlapping portion where said edge regions of said adjacent ones of said divided portions overlap each other.

To achieve these and other objects in accordance with the principles of the present invention, as embodied and broadly described, the present invention provides a method, comprising: emitting electron beams from an electron gun toward a tension mask assembly; passing said electron beams through said tension mask assembly at locations corresponding to first and second slots formed by said tension mask assembly; blocking said electron beams from passing through said tension mask assembly at locations corresponding to first and second strips formed by said tension mask assembly; blocking said electron beams from passing through said tension mask assembly at locations corresponding to first and second bridges formed by said tension mask assembly, said tension mask assembly having at least two divided portions, each one of said at least two divided portions having a plurality of said first strips separated a predetermined distance from each other by said first slots, and each of said divided portions having a plurality of said first bridges for connecting said first strips to each other and for defining said first slots, each of said divided portions having at least one edge region, said edge regions of adjacent ones of said divided portions overlapping each other and being connected with each other at an overlapping portion, said overlapping edge regions forming said second slots and said second strips at said overlapping portion, said first strips having same shape as said second strips, said first slots having same shape as said second slots; and forming a frictional force between said adjacent ones of said divided portions, at said overlapping portion where said edge regions of said adjacent ones of said divided portions overlap each other.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

Figure 1:
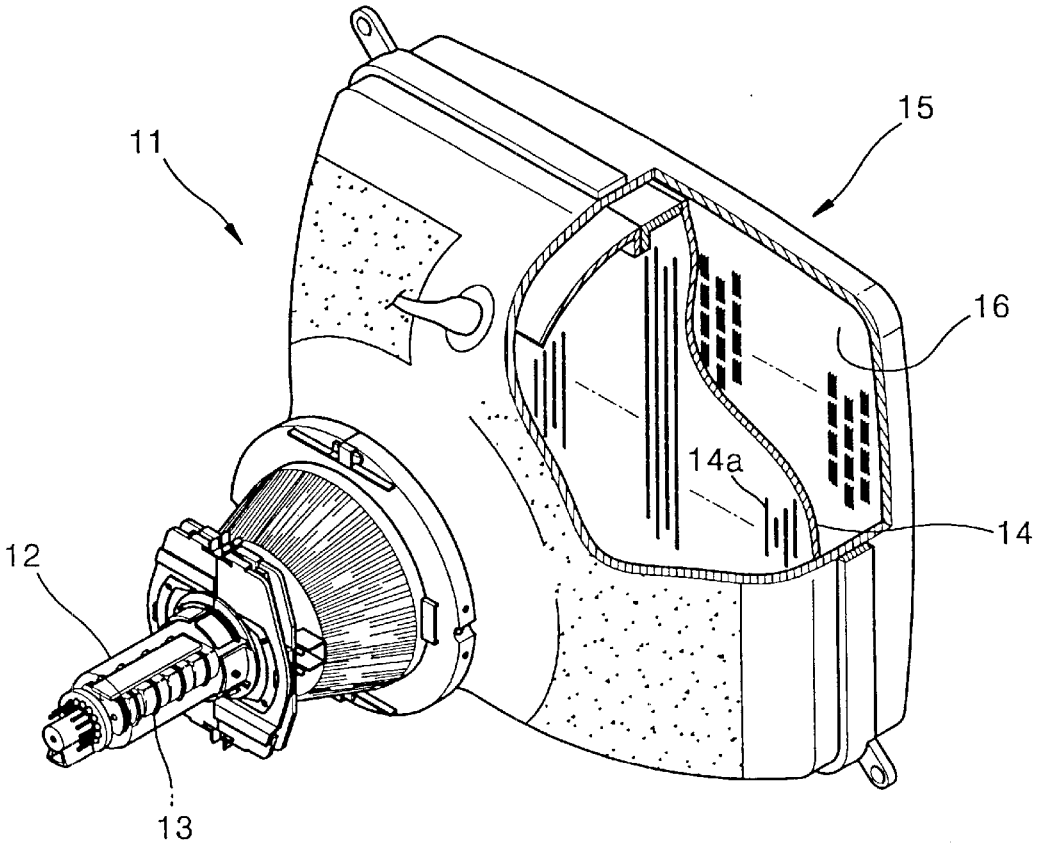
FIG. 1 is a partially cut-away perspective view of a color cathode ray tube.

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Additionally, the embodiments disclosed can be combined, in keeping within the principles of the present invention.

In a typical color cathode ray tube (CRT), three electron beams (red, green and blue) are emitted from an electron gun installed in a neck portion of a funnel and pass through numerous electron beam passing holes formed in a shadow mask having a color selection function. Then, the electron beams land on red, green and blue fluorescent substances of a fluorescent film formed on an inner surface of a panel coupled to the funnel forming a seal. As the fluorescent substances are excited, a predetermined image is formed.

For the above color cathode ray tube, a screen surface needs to be made flat to increase a viewing angle and to prevent distortion of an image, and also a panel needs to be made flat. Accordingly, a shadow mask installed inside the color cathode ray tube and having a color selection function needs to be made flat.

To realize the above needs, a shadow mask for a color cathode ray tube has a frame including first and second support members installed parallel to each other, and including first and second elastic members with ends of each of the elastic members being fixed to the first and second support members. A flat type tension mask, having slots forming electron beam passing holes in strips by connecting a plurality of strips separated a predetermined distance from each other by bridges, is welded to the first and second support members while receiving tension.

However, in the tension mask assembly for a color cathode ray tube, the tension mask is formed of a thin plate having a thickness of 0.1–0.25 millimeters (mm) and welded to the frame while receiving tension by the frame. In particular, the long side portions of the tension mask are fixed to the support members of the frame while the short side portions thereof are not fixed to the frame. Thus, the tension mask easily vibrates due to a small impact applied from the outside.

Thus, the electron beam emitted from the electron gun does not pass through the slots (electron beam passing holes) with an accurate amount and does not land on a predetermined position on a fluorescent substance. As a result, a howling phenomenon, that is, a screen trembling, is generated and the resolution of the screen is lowered.

FIG. 1 is a partially cut-away perspective view of a color cathode ray tube. Referring to FIG. 1, three electron beams (red, green and blue) are emitted from an electron gun 13 installed in a neck portion 12 of a funnel 11 and pass through numerous electron beam passing holes 14*a* formed in a shadow mask 14 having a color selection function. Then, the electron beams land on red, green and blue fluorescent substances of a fluorescent film 16 formed on an inner surface of a panel 15 coupled to the funnel 11 forming a seal. As the fluorescent substances are excited, a predetermined image is formed.

For the above color cathode ray tube of FIG. 1, a screen surface is needed to be made flat to increase a viewing angle and to prevent distortion of an image, and also a panel is needed to be made flat. Accordingly, a shadow mask installed inside the color cathode ray tube of FIG. 1 and having a color selection function is needed to be made flat.

Figure 2:
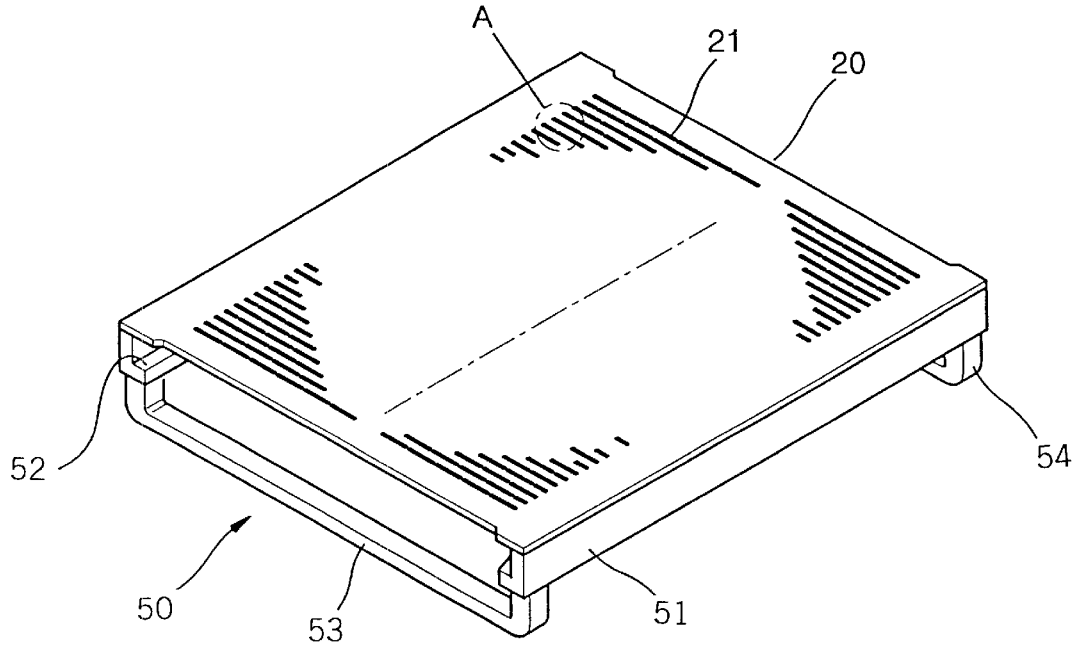
FIG. 2 is a perspective view of a tension mask assembly for a color cathode ray tube.
Figure 3:
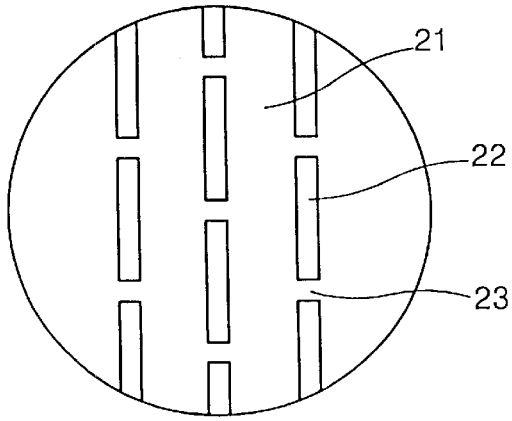
FIG. 3 is an enlarged view of a portion A of FIG. 2.

FIG. 2 is a perspective view of a tension mask assembly for a color cathode ray tube. FIG. 3 is an enlarged view of a portion A shown in FIG. 2. To realize the above needs, a shadow mask for a color cathode ray tube, as shown in FIG. 2, and as shown in FIG. 3 which is an enlarged view of a circled portion A, includes a frame 50 including first and second support members 51 and 52 installed parallel to each other and first and second elastic members 53 and 54 both ends of each of which are fixed to each of the first and second support members 51 and 52. A flat type tension mask 20 having slots 22 forming electron beam passing holes in strips by connecting a plurality of strips 21 separated a predetermined distance from each other by bridges 23, is welded to the first and second support members 51 and 52 while receiving tension.

However, in the tension mask assembly shown in FIGS. 2 and 3, the tension mask 20 is formed of a thin plate having a thickness of 0.1–0.25 millimeters and welded to the frame 50 while receiving tension by the frame 50. In particular, the long side portions of the tension mask 20 are fixed to the support members 51 and 52 of the frame 50 while the short side portions of the tension mask 20 are not fixed to the frame 50. Thus, the tension mask 20 easily vibrates due to a small impact applied from the outside.

Figure 4:
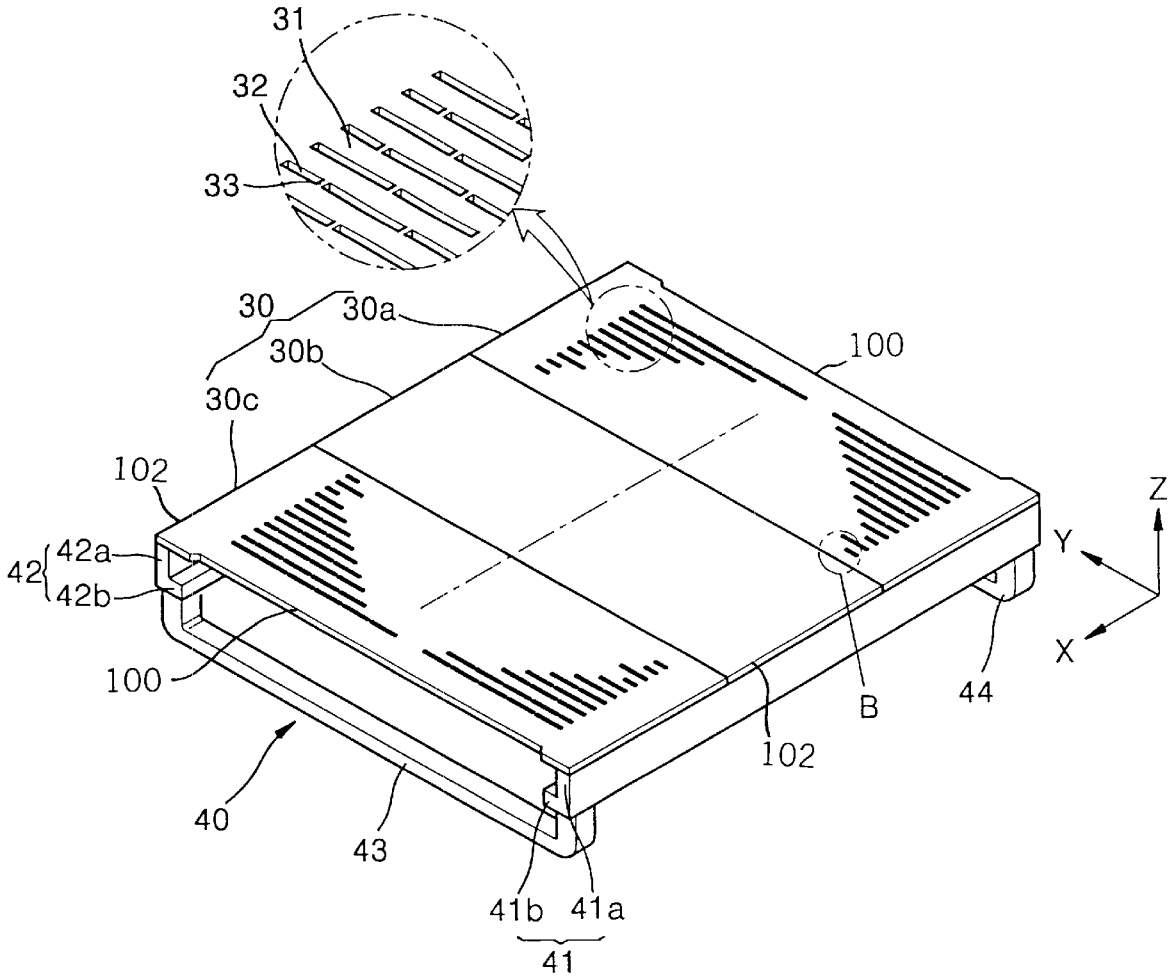
FIG. 4 is a perspective view of a tension mask assembly for a color cathode ray tube according to a preferred embodiment of the present invention.
Figure 5A:
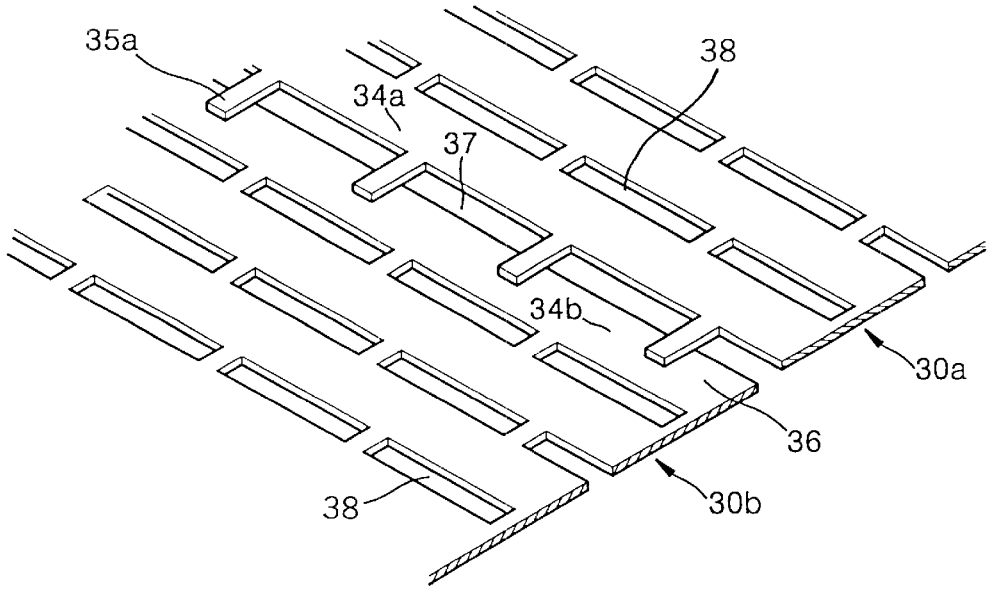
FIG. 5A is an enlarged perspective view of a portion B of two adjacent mask separation member in the tension mask of FIG. 4.

Referring to FIGS. 4 and 5A, a tension mask assembly for a color cathode ray tube according to a preferred embodiment of the present invention includes a tension mask 30 and a frame 40. The tension mask 30 is formed by three divided portions 30*a*, 30*b* and 30*c* which are continuously contacting one another. Each of the three divided portions 30*a*, 30*b* and 30*c* includes a plurality of strips 31, slots 32, and bridges 33. The strips 31 are separated a predetermined distance from each other and form the slots 32. The plurality of bridges 33 define the slots 32 by connecting the strips 31. The frame 40 includes first and second support members 41 and 42 for supporting both end portions of each of the divided portions 30*a*, 30*b* and 30*c* to apply tension to the strips 31 of the divided portions 30*a*, 30*b* and 30*c*, and a pair of first and second elastic members 43 and 44 for supporting the first and second support members 41 and 42.

In FIG. 4, the end portions of the tension mask 30 are supported by support members 41 and 42. These end portions can also be referred to as end regions.

In FIG. 5A, the separation portions 34*a* and 34*b* can also be referred to as edge regions 34*a* and 34*b*. The separation portion 34*a* has a plurality of similarly shaped and spaced bridges 35*a* extending outward to overlap the separation portion 34*b*. These bridges 35*a* in FIG. 5A can be referred to as protrusions.

The divided portions 30*a*, 30*b* and 30*c* are connected such that, as shown in FIG. 5A, bridges 35*a* extending from one of separation portions 34*a* and 34*b* of the divided portions 30*a* and 30*b* within a range of not covering other slots 38, can overlap a strip 36 of the separation short side portion 34*b* of the adjacent divided portion 30*b* to form slots 37 which are identically repeated to the slots 38 of divided portions 30*a* and 30*b*.

Further, the contact between the divided portions 30*a* and 30*b* must be formed such that the width of the slot 37 made by the separation short side portions 34*a* and 34*b* can be the same as the width of the slot 38 of the non separation portion.

Figure 5B:
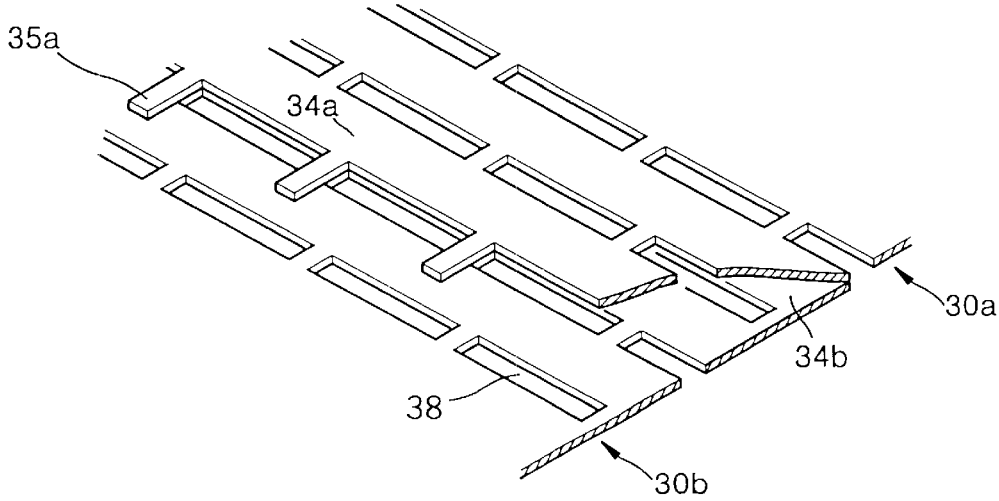
FIGS. 5B, 6A, 6B, 7A, 7B and 8 are perspective views showing an overlapped portion of the two adjacent mask separation member in the tension mask according to other preferred embodiments of the present invention.

As shown in FIG. 5B, the overlapped portion between the two divided portions 30*a* and 30*b* which are continuously contacting each other preferably has a width which is equal to a width of two strips. However, the width is not limited to the above but can be more, within a scope of the present invention.

Referring to FIG. 4, the frame 40 includes the first and second support members 41 and 42 separated a predetermined distance from each other and the first and second elastic members 43 and 44, both end portions of each of which are supported at both ends of the first and second support members 41 and 42. The first and second support members 41 and 42 have fixed portions 41*a* and 42*a* and flange portions 41*b* and 42*b* extending inwardly from the lower portions of the fixed portions 41*a* and 42*a*. The profile of each of the first and second support members 41 and 42 is L-shaped.

Both end portions of the first and second elastic members 43 and 44 are coupled to end portions of each of the first and second support members 41 and 42. The first and second elastic members 43 and 44 are U-shaped so as to support the first and second support members 41 and 42 and the profile of each of the first and second elastic members 43 and 44 is rectangular or L-shaped.

Although the frame 40 is described with an example of having the first and second support members 41 and 42, and having the first and second elastic members 43 and 44 supporting the first and second support members 41 and 42, the structure of the frame 40 is not limited to the above and any structure capable of applying tension to the tension mask in a direction Y can be adopted. Alternatively, both end portions of the first and second elastic members 43 and 44 for supporting the first and second support members 41 and 42 can be fixed at positions separated a predetermined distance from the end portions of the first and second support members 41 and 42 toward the center of the first and second support members 41 and 42 so that a support force for applying tension to the tension mask 30 can be uniform.

Figure 6A:
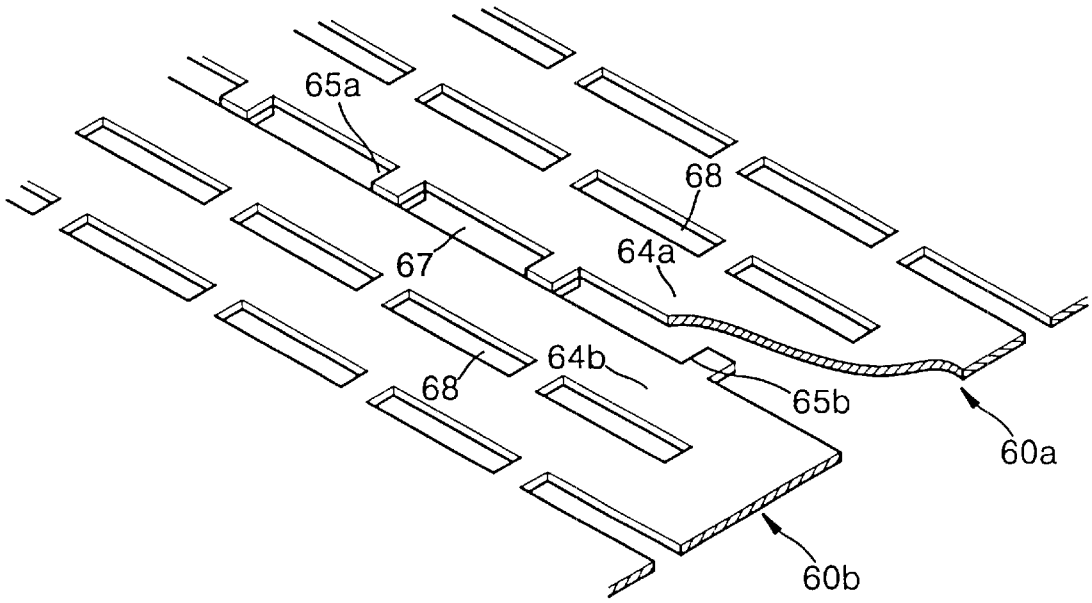

FIG. 6A shows a contact portion of two adjacent divided portions in a tension mask assembly for a color cathode ray tube according to another preferred embodiment of the present invention.

Here, the tension mask assembly for a color cathode ray tube according to another preferred embodiment of the present invention shown in FIG. 6A has the same structure as that of the tension mask assembly shown in FIGS. 4 and 5A, except for a contact structure of the adjacent divided portions. Thus, in this preferred embodiment, adjacent divided portions 60*a* and 60*b* shown in FIG. 6A are described while other common elements will not be described.

Referring to the FIG. 6A, the divided portions 60*a* and 60*b* are overlapped with each other such that bridges 65*a* and 65*b* extending from each of separation short side portions 64*a* and 64*b* of the divided portions 60*a* and 60*b* at both sides can form slots 67. Here, the bridges 65*a* and 65*b* extending from the separation short side portions 64*a* and 64*b* can be freely extended within a range of not covering other slots 68.

Further, the contact between the divided portions 60*a* and 60*b* must be formed such that the width of slot 67 made by the separation short side portions 64*a* and 64*b* can be the same as the width of the slot 68 of the non separation portion.

Figure 6B:
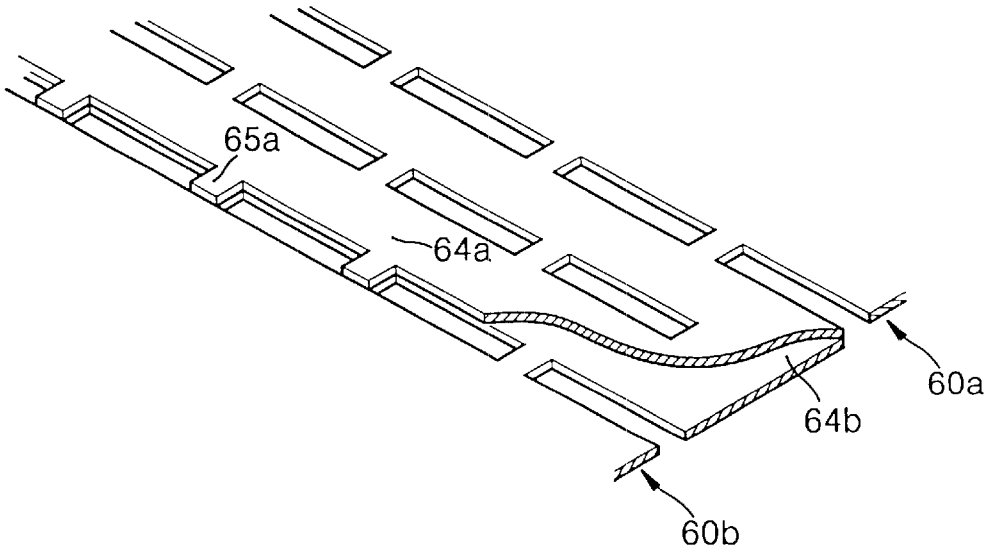

As shown in FIG. 6B, the overlapped portion between the two divided portions 60*a* and 60*b* which are continuously contacting each other preferably has a width which is equal to a width of two strips. However, the width is not limited to the above but can be more, within a scope of the present invention.

Figure 7A:
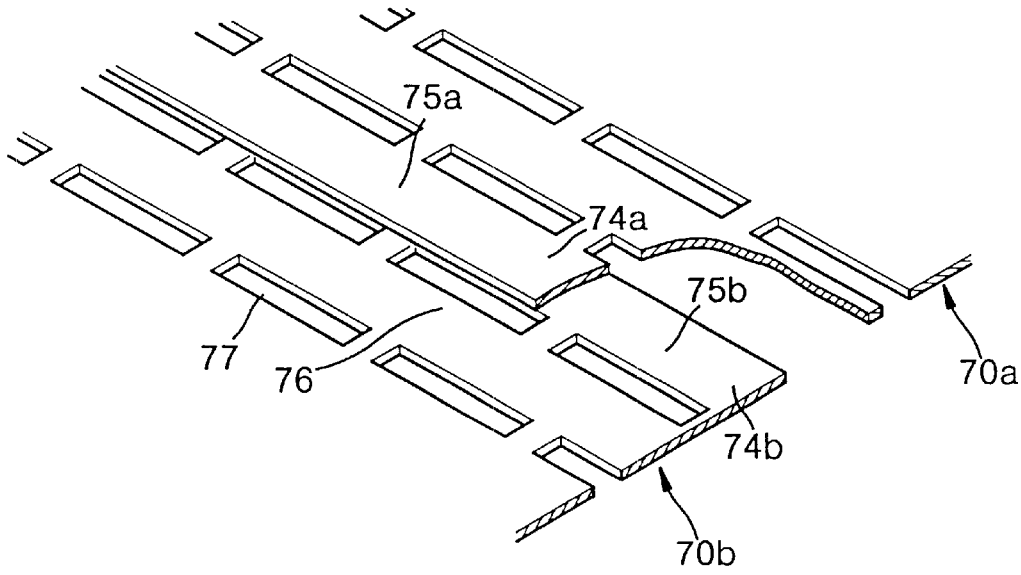

FIG. 7A shows a contact portion of two adjacent divided portions in a tension mask assembly for a color cathode ray tube according to yet another preferred embodiment of the present invention.

Here, since the tension mask assembly for a color cathode ray tube according to this preferred embodiment of the present invention shown in FIG. 7A has the same structure as that of the tension mask assembly shown in FIGS. 4 and 5A, except for continuously contacting adjacent divided portions 70*a* and 70*b*, the adjacent divided portions 70*a* and 70*b* are described while other common elements will not be described.

As shown in the drawing, it is a characteristic feature that the divided portions 70*a* and 70*b* are overlapped with each other such that strips 75*a* and 75*b* of separation short side portions 74*a* and 74*b* of the divided portions 70*a* and 70*b* have the same width as those of strips 76 of a non separation portion.

Here, the widths of the strips 75*a* and 75*b* of the separation short side portions 74*a* and 74*b* can be freely set within a range of not covering other slots 77.

Preferably, a means (not shown) for increasing a frictional force such as a plurality of protrusions or beads is formed at the strips 75*a* and 75*b* which are contact portions between the divided portions 70*a* and 70*b* so that transfer of vibrations of the divided portion 70*a* to the adjacent divided portion 70*b* is alleviated.

Figure 7B:
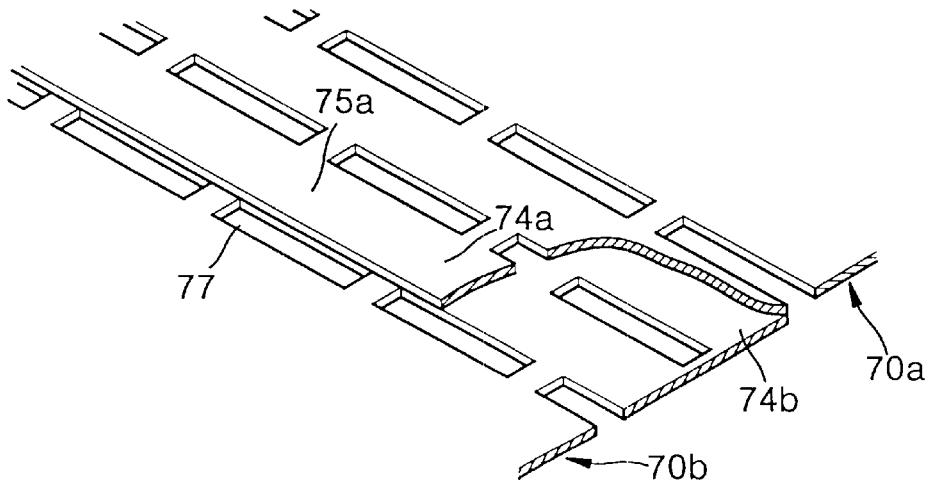

As shown in FIG. 7B, the overlapped portion between the two divided portions 70*a* and 70*b* which are continuously contacting each other preferably has a width which is equal to a width of two strips. However, the width is not limited to the above but can be more, within a scope of the present invention.

Figure 8:
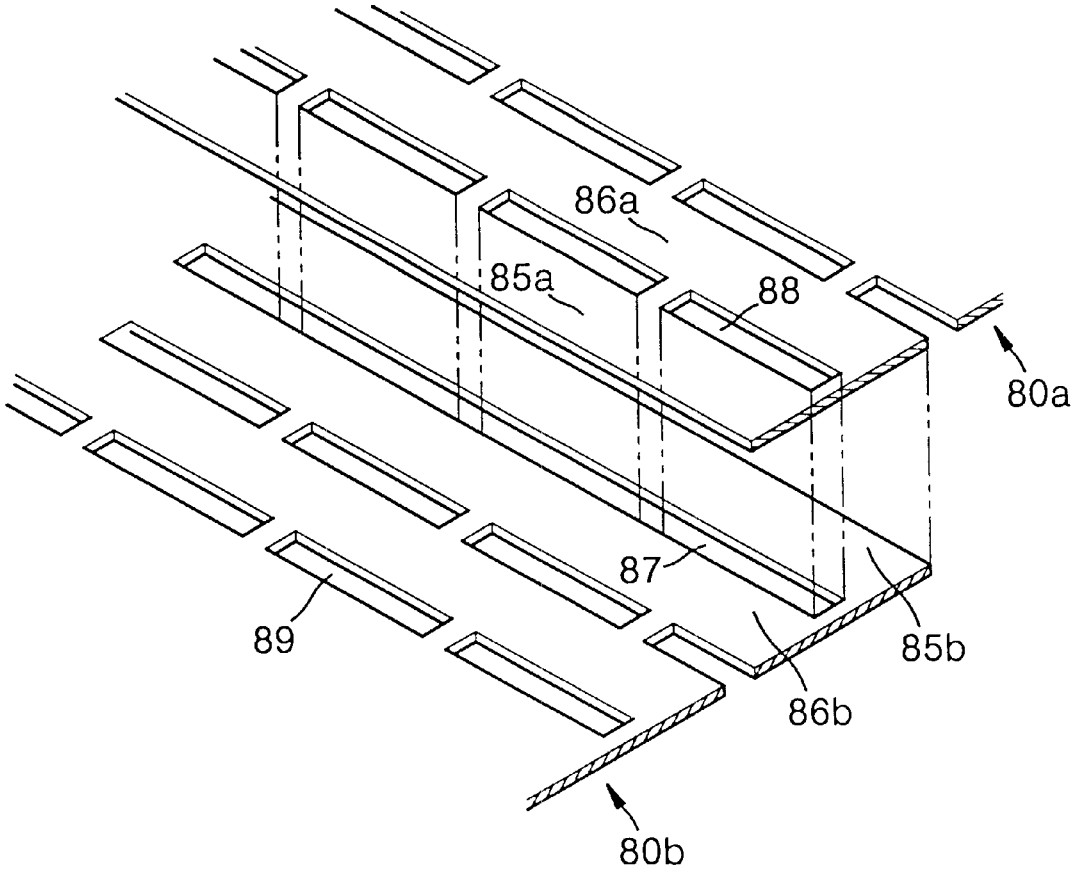

FIG. 8 is an exploded perspective view of a contact portion of two adjacent divided portions in a tension mask assembly for a color cathode ray tube according to yet still another preferred embodiment of the present invention.

Here, since the tension mask assembly for a color cathode ray tube according to this preferred embodiment of the present invention shown in FIG. 8 has the same structure as that of the tension mask assembly shown in FIGS. 4 and 5A, except for continuously contacting adjacent divided portions 80*a* and 80*b*, the adjacent divided portions 80*a* and 80*b* are described while other common elements will not be described.

As shown in the drawing, strips 85*b* and 86*b* located at an overlapped portion of the divided portion 80*b* of the continuously contacting divided portions 80*a* and 80*b* independently form a single slot 87. Strips 85*a* and 86*a* located at an overlapped portion of the other divided portion 80*a* form slots 88 repeating identically with slots 89 of a non separation portion.

Also, the strips 85*b* and 86*b* located at the overlapped portion of the divided portion 80*b* of the continuously contacting divided portions 80*a* and 80*b* can be connected by at least one bridge (not shown) so as to define the slots.

In the present embodiment, as shown in FIG. 8, the overlapped portion between the two divided portions 80*a* and 80*b* which are continuously contacting each other has a width which is equal to a width of two strips. However, the width is not limited to the above but can be three or more, within a scope of the present invention. Thus, an independent single slot or a plurality of slots formed by the strips may be two or more lines.

In the operation of the tension mask for a color cathode ray tube according to the present invention, referring to FIGS. 4 and 5A, when the first and second support members 41 and 42 are pressed in the opposite directions to each other so that the first and second elastic members 43 and 44 supporting the first and second support members 41 and 42 can be elastically deformed, since the long side portions 102 of the tension mask 30 are welded to the fixed portions 41 a and 42*a* of the first and second support members 41 and 42, tension is applied to the tension mask 30 in a lengthwise direction of the strip 31.

Accordingly, since the tension mask 30 receives tension only in the lengthwise direction of the strip 31 and the short side portion 100 of the tension mask 30 is not fixed to the frame 40, the tension mask 30 can be easily vibrated by a small impact from the outside in a direction X or Z.

However, the tension mask 30 is separated into a plurality of divided portions (three divided portions in the case of the tension mask shown in FIGS. 4 and 5A). The separation short side portions 34*a* and 34*b* of these divided portions form the same slots as the slots 38 of the non separation portion. Since the bridges 35*a* extending from the short side portion 34*a* overlap the strip 36 of the adjacent separation short side portion 34*b*, friction between the bridges 35*a* and the strip 36 can remarkably reduce vibrations transferred to other divided portions in the direction X or Z of a divided portion. Thus, vibrations of the tension mask 30 due to the external impacts can be alleviated as a whole.

In particular, by forming a means for increasing a frictional force such as a plurality of protrusions or beads (not shown) at the bridges 35*a* which are contact portions between the two adjacent divided portions 30*a* and 30*b*, the frictional force is further increased so that the vibration alleviation function can be improved much.

Also, when the overlapped portion of the continuously contacting divided portions has the same width as that of at least two strips, the frictional force between the divided portions increases so that the vibration alleviation function of one divided portion with respect to the adjacent other divided portion can be further improved.

As described above, in the tension mask assembly for a color cathode ray tube according to the present invention, since the tension mask is separated into a plurality of divided portions in a lengthwise direction of the slot and these divided portions are continuously overlapped with each other such that the bridges or strips extending from the separation short side portions can form the same slots or strips as those of the non separation portion, vibrations of one divided portion due to the external impact, in particular, vibrations in a direction perpendicular to the lengthwise direction of the slot, can be prevented from being transferred to other adjacent divided portions by the friction between the overlapped portions. Thus, vibrations of the tension mask as a whole can be drastically reduced.

Therefore, the tension mask assembly for a color cathode ray tube according to the present invention can prevent a howling phenomenon and lowering of resolution of a screen which are generated because the electron beams emitted from the electron gun do not accurately pass the slots which are electron beam passing holes and land on predetermined positions of the fluorescent substances.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A tension mask assembly for a color cathode ray tube, comprising:

a tension mask including at least two divided portions, each of said portions having a plurality of first strips separated a predetermined distance from each other by first slots, and each of said portions having a plurality of first bridges for connecting said first strips to each other and for defining said first slots; and a frame including first and second support members supporting end regions of said portions, and including at least one pair of elastic members to support said first and second support members and to apply tension to said first strips of said portions.

2. The assembly of claim 1, each of said divided portions having at least one edge region, said edge regions of adjacent ones of said divided portions overlapping each other and being connected with each other at an overlapping portion, said overlapping edge regions forming second slots and second strips at said overlapping portion, said first strips having same shape as said second strips, said first slots having same shape as said second slots.

3. The assembly of claim 2, said at least one edge region of at least one of said divided portions having an extended portion extending outward from a position where said first bridges are identically repeated.

4. The assembly of claim 2, said at least one edge region of at least one of said divided portions having a shape of one of said first strips of an adjacent one of said divided portions.

5. The assembly of claim 2, said overlapping portion having same width as at least one of said first strips.

6. The assembly of claim 2, wherein one of said overlapping edge regions has a plurality of additional strips independently forming a single slot.

7. The assembly of claim 2, at least a first one of said divided portions having a plurality of said first strips independently forming a single slot at one of said edge regions of said first one of said divided portions.

8. The assembly of claim 2, at least a first one of said divided portions having a plurality of additional strips independently forming a single slot at one of said edge regions of said first one of said divided portions.

9. The assembly of claim 2, wherein one of said overlapping edge regions has a plurality of additional strips connected by at least one bridge to form slots.

10. The assembly of claim 2, at least a first one of said divided portions having a plurality of said first strips connected by at least one bridge to form slots at one of said edge regions of said first one of said divided portions.

11. The assembly of claim 2, at least a first one of said divided portions having a plurality of additional strips connected by at least one bridge to form slots at one of said edge regions of said first one of said divided portions.

12. An apparatus, comprising:

a tension mask including at least two divided portions, each one of said portions having a plurality of first strips separated a predetermined distance from each other by first slots, and each of said portions having a plurality of first bridges for connecting said first strips to each other and for defining said first slots; and a frame including first and second support members supporting end regions of said divided portions, and including at least one pair of elastic members to support said first and second support members and to apply tension to said first strips of said portions;

adjacent divided portions selected from among said at least two divided portions partly overlapping each other at an overlapping portion, with a frictional force being formed at said overlapping portion.

13. The apparatus of claim 12, each of said divided portions having at least one edge region, said edge regions of adjacent ones of said divided portions overlapping each other and being continuously connected with each other at said overlapping portion, said overlapping edge regions forming second slots and second strips at said overlapping portion, said first strips having same shape as said second strips, said first slots having same shape as said second slots.

14. A method, comprising:

emitting electron beams from an electron gun toward a tension mask assembly;

passing said electron beams through said tension mask assembly at locations corresponding to first and second slots formed by said tension mask assembly;

blocking said electron beams from passing through said tension mask assembly at locations corresponding to first and second strips formed by said tension mask assembly;

blocking said electron beams from passing through said tension mask assembly at locations corresponding to first and second bridges formed by said tension mask assembly, said tension mask assembly having at least two divided portions, each one of said at least two divided portions having a plurality of said first strips separated a predetermined distance from each other by said first slots, and each of said divided portions having a plurality of said first bridges for connecting said first strips to each other and for defining said first slots, said tension mask assembly having a frame including first and second support members supporting end regions of said divided portions, and including at least one pair of elastic members to support said first and second support members and to apply tension at least to said first strips of said divided portions, each of said divided portions having at least one edge region, said edge regions of adjacent ones of said divided portions overlapping each other and being connected with each other at an overlapping portion, said overlapping edge regions forming said second slots and said second strips at said overlapping portion, said first strips having same shape as said second strips, said first slots having same shape as said second slots; and forming a frictional force between said adjacent ones of said divided portions, at said overlapping portion where said edge regions of said adjacent ones of said divided portions overlap each other.

15. The method of claim 14, said overlapping portion including a first divided portion partly overlapping a second divided portion, said first and second divided portions being selected from among said at least two divided portions, said first divided portion having an extended portion with a plurality of protrusions extending outward, said plurality of protrusions forming said second bridges at said overlapping portion.

16. A method, comprising:

emitting electron beams from an electron gun toward a tension mask assembly;

passing said electron beams through said tension mask assembly at locations corresponding to first and second slots formed by said tension mask assembly;

blocking said electron beams from passing through said tension mask assembly at locations corresponding to first and second strips formed by said tension mask assembly;

blocking said electron beams from passing through said tension mask assembly at locations corresponding to first and second bridges formed by said tension mask assembly, said tension mask assembly having at least two divided portions, each one of said at least two divided portions having a plurality of said first strips separated a predetermined distance from each other by said first slots, and each of said divided portions having a plurality of said first bridges for connecting said first strips to each other and for defining said first slots, each of said divided portions having at least one edge region, said edge regions of adjacent ones of said divided portions overlapping each other and being connected with each other at an overlapping portion, said overlapping edge regions forming said second slots and said second strips at said overlapping portion, said first strips having same shape as said second strips, said first slots having same shape as said second slots; and forming a frictional force between said adjacent ones of said divided portions, at said overlapping portion where said edge regions of said adjacent ones of said divided portions overlap each other.

17. The method of claim 16, said tension mask assembly having a frame including first and second support members supporting end regions of said divided portions, and including at least one pair of elastic members to support said first and second support members and to apply tension at least to said first strips of said divided portions, said edge regions of adjacent ones of said divided portions overlapping each other and being continuously connected with each other at said overlapping portion.

18. The method of claim 17, said at least one edge region of at least one of said divided portions having an extended portion extending outward from a position where said first bridges are identically repeated.

19. The method of claim 17, said at least one edge region of at least one of said divided portions having a shape of one of said first strips of an adjacent one of said divided portions.

20. The method of claim 17, said overlapping portion having same width as at least one of said first strips.

21. The method of claim 17, wherein one of said overlapping edge regions has a plurality of additional strips independently forming a single slot.

22. The method of claim 17, at least a first one of said divided portions having a plurality of said first strips independently forming a single slot at one of said edge regions of said first one of said divided portions.

23. The method of claim 17, at least a first one of said divided portions having a plurality of additional strips independently forming a single slot at one of said edge regions of said first one of said divided portions.

24. The method of claim 17, wherein one of said overlapping edge regions has a plurality of additional strips connected by at least one bridge to form slots.

25. The method of claim 17, at least a first one of said divided portions having a plurality of said first strips connected by at least one bridge to form slots at one of said edge regions of said first one of said divided portions.

26. The method of claim 17, at least a first one of said divided portions having a plurality of additional strips connected by at least one bridge to form slots at one of said edge regions of said first one of said divided portions.

27. The method of claim 17, said overlapping portion including a first divided portion partly overlapping a second divided portion, said first and second divided portions being selected from among said at least two divided portions, said first divided portion having an extended portion with a plurality of protrusions extending outward, said plurality of protrusions forming said second bridges at said overlapping portion.

* * * * *